US005265353A

United States Patent [19]

Marega et al.

[11] Patent Number: 5,265,353

[45] Date of Patent: Nov. 30, 1993

[54] TONGUE FOR THE ANATOMICAL LINER OF A RIGID-SHELL SKI-BOOT

[75] Inventors: Antonello Marega, Montebelluna; Andrea Gabrielli, Predazzo, both of Italy

[73] Assignee: Calzaturificio Tecnica Spa, Nervesa della Battaglia, Italy

[21] Appl. No.: 953,857

[22] Filed: Sep. 30, 1992

[30] Foreign Application Priority Data

Oct. 15, 1991 [IT] Italy ..... TV91A000095

[51] Int. Cl.[5] ..... A43B 5/04

[52] U.S. Cl. ..... 36/117; 36/54; 36/132

[58] Field of Search ..... 36/10, 50.5, 54, 55, 36/71, 96, 117-121, 132, 136, 109, 50.1, 70 R, 71.5, 72 R, 107, 114, 133

[56] References Cited

U.S. PATENT DOCUMENTS

| | | | |
|---|---|---|---|
| 1,781,950 | 11/1930 | Hilgert | 36/54 |
| 2,244,031 | 6/1941 | Teehan | 36/54 |
| 2,915,837 | 12/1959 | Schlecht | 36/54 |
| 3,169,325 | 2/1965 | Fesl | 36/54 |
| 3,284,931 | 11/1966 | Dassler | 36/54 |
| 4,372,060 | 2/1983 | Adamik | 36/54 |
| 4,630,383 | 12/1986 | Gamm | 36/136 |
| 4,805,321 | 2/1989 | Tonkel | 36/54 |
| 4,920,666 | 5/1990 | Marega | 36/10 |
| 4,955,150 | 9/1990 | Fagan | 36/136 |
| 5,174,050 | 12/1992 | Gabrielli | 36/55 |

FOREIGN PATENT DOCUMENTS

| | | | |
|---|---|---|---|
| 1817998 | 2/1977 | Fed. Rep. of Germany | 36/120 |
| 0654467 | 2/1986 | Switzerland | 36/10 |

*Primary Examiner*—Steven N. Meyers
*Assistant Examiner*—Thomas P. Hilliard
*Attorney, Agent, or Firm*—Griffin Butler Whisenhunt & Kurtossy

[57] ABSTRACT

The tongue for the anatomical liner of a rigid-shell ski-boot consists essentially of a front portion 10, made of rigid material, intended to engage with the internal wall of the boot, and a rear portion 12, generally padded, intended to engage with the user's leg. Between the front portion 10 and the rear portion 12 there is provided a substantially longitudinal recess 24 designed to receive filling material and/or elements 28, 50, 52 for modifying the thickness of the tongue. Strips 32, 14 for securing the filling material and/or elements 28, 50, 52 inside the recess 24 are also provided.

10 Claims, 2 Drawing Sheets

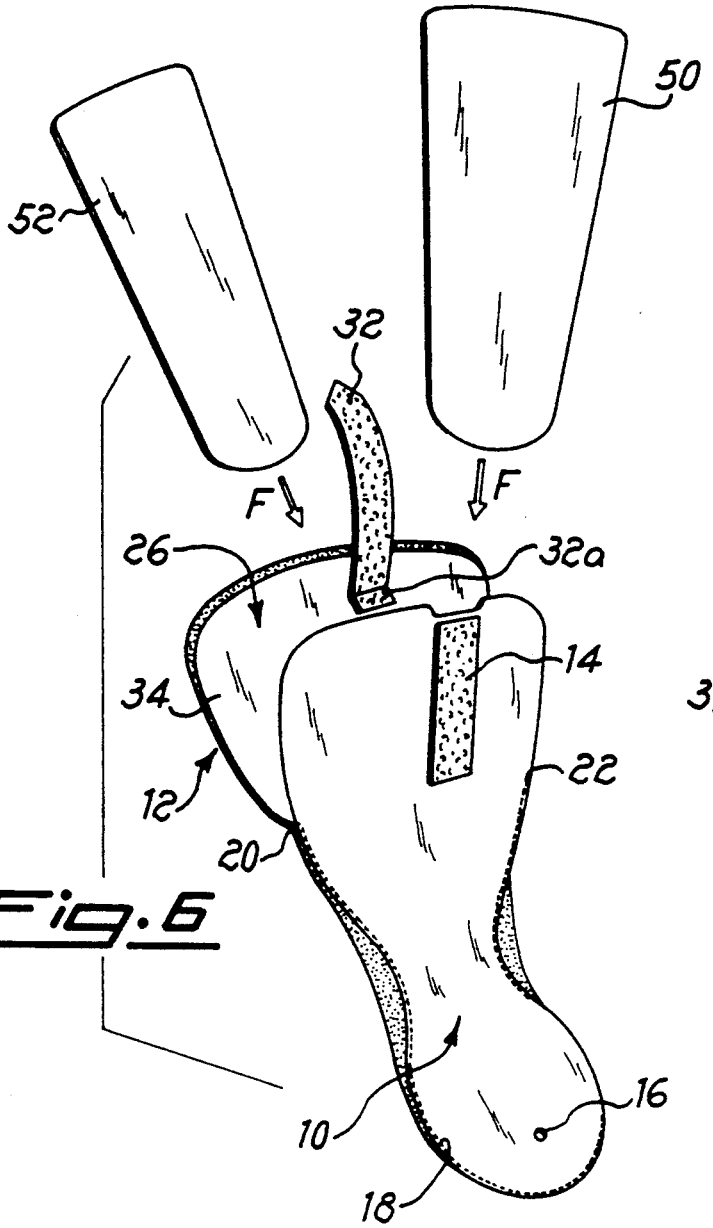
Fig. 6
Fig. 5
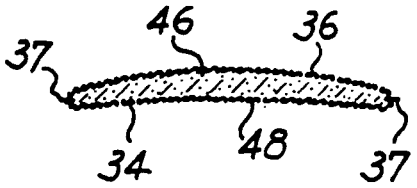
Fig. 7
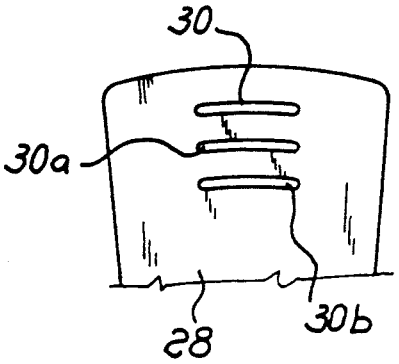
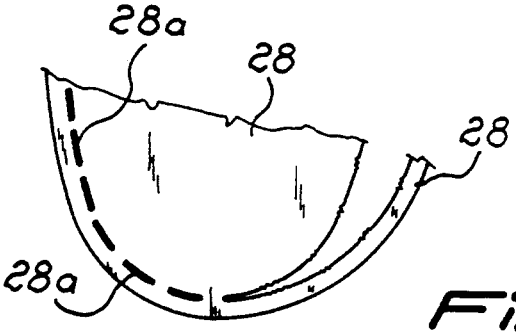
Fig. 8

TONGUE FOR THE ANATOMICAL LINER OF A RIGID-SHELL SKI-BOOT

The present invention relates to a tongue for the anatomical liner of a rigid-shell ski-boot of plastic or similar material.

BACKGROUND OF THE INVENTION

Tongues of the type in question are already known and it is also known that they consist of a front portion made of rigid material, such as plastic for example, intended to engage with the internal wall of the boot, a padded portion being applied to the rear of said front portion and being intended to engage with the user's leg, in particular with the shin and zone surrounding it.

In this way, when the boot is put on, its flaps close over each other, being secured by the usual clamping levers, and the front flaps of the anatomical liner correspondingly move towards each other, the said liner being arranged inside the boot into which the user inserts his/her foot, the instep of which is duly enclosed by the aforementioned flaps which partially overlap the abovementioned tongue.

Tongues of the conventional type, while performing in a satisfactory manner the function assigned to them, i.e. principally that of protecting the user's shin, nevertheless possess drawbacks which mean that they are not yet entirely reliable or satisfactory in terms of their use.

The abovementioned drawbacks are all due to the fact these tongues consist of a single-piece body in which the padded part is fixed completely to the rigid portion, so that their thickness remains that established by the manufacturer. A common experience in the area of ordinary footwear as well, is that frequently two persons will ask for the same model of shoe and the same size, but whereas the shoe will fit one person perfectly, it may cause considerable problems for the other person such that he or she will discard that particular type of shoe.

In fact the two abovementioned parameters are not determining factors at all when choosing a shoe since the shape of foot may vary considerably from one person to another.

The abovementioned drawbacks obviously also occur in the case of ski-boots and in fact they are accentuated precisely on account of the particularly use of this type of footwear, i.e. mainly for competitive purposes where the foot is subjected to a considerable amount of stress so that the boot must not be uncomfortable at all for the wearer and at the same time must possess good stability characteristics.

A tongue for the anatomical liner of a rigid-shell ski-boot which is able to overcome all of the abovementioned drawbacks has now been devised and forms the subject of the present invention.

It is therefore one of the main aims of the present invention to provide a tongue as defined above, the particular and original design of which enables its thickness to be modified according to the shape of the user's foot, in particular the zone in the region of the shin.

Another not insignificant aim of the present invention is to provide a tongue of the type in question as a result of which the modifications referred to above may be performed by the user him/herself according to the specific requirements which may arise in each case when using the boot.

SUMMARY OF THE INVENTION

The present invention therefore relates to a tongue for the anatomical liner of a rigid-shell ski-boot, consisting essentially of a front part, made of rigid material, intended to engage with the internal wall of the boot and a rear part, generally padded, intended to engage with the user's leg, which is characterized in that between said front and rear portions there is provided a substantially longitudinal recess designed to receive filling material and/or elements for modifying the thickness of the tongue, there being provided moreover means for securing said filling material and/or elements inside the recess.

The characteristic features as well as the advantages of the tongue according to the present invention will appear more clearly from the following detailed description of two of its non-limiting embodiments, with reference to the accompanying figures.

BRIEF DESCRIPTION OF THE DRAWINGS

FIG. 5 is a view of only the rear part of the tongue along the section V—V of FIG. 3;

FIG. 6 is a partially exploded, schematic, perspective view of the second embodiment of the tongue according to the invention;

FIG. 7 is a view illustrating a possible modification of the insert according to FIGS. 1 to 3; and FIG. 8 is a view illustrating a further possible modification of the abovementioned insert.

DESCRIPTION OF PREFERRED EMBODIMENTS

With reference to FIGS. 1 to 5, the first embodiment of the tongue according to the invention will now be described.

Figure 1:
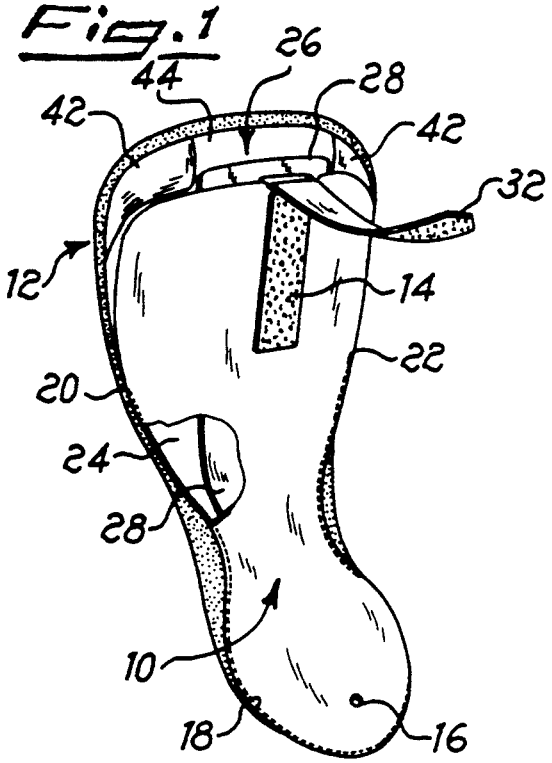
FIG. 1 is a perspective view of a first embodiment of the tongue in its position during use, provided with a removable insert.
Figure 2:
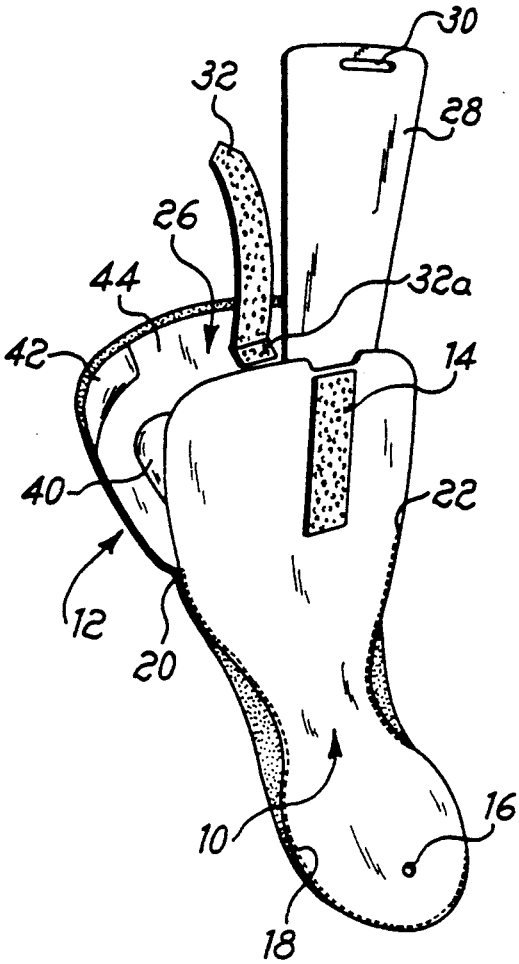
FIG. 2 is a perspective view of the tongue of FIG. 1 with the abovementioned insert almost entirely removed.
Figure 3:
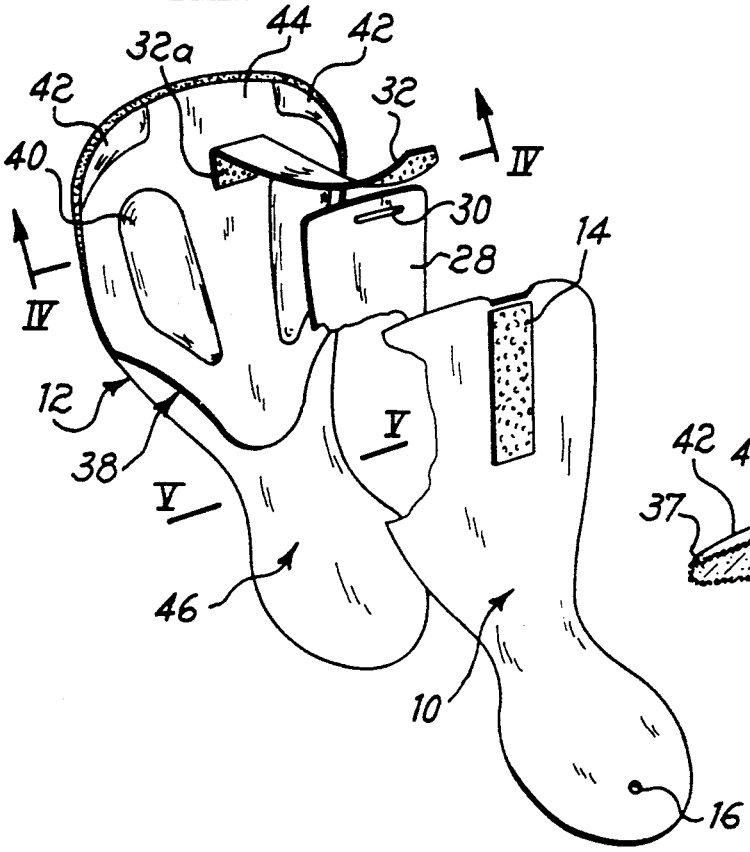
FIG. 3 is an exploded perspective view with the tongue of FIG. 1 partially removed.
Figure 4:
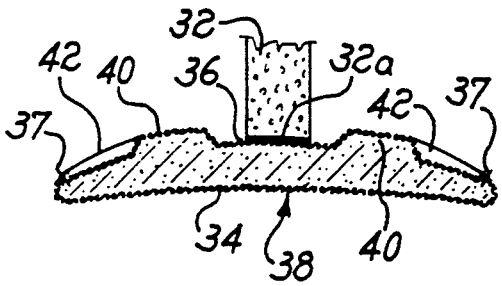
FIG. 4 is a view of only the rear part of the tongue along the section IV—IV of FIG. 3.

With reference first of all to FIGS. 1 to 3, the tongue according to the present invention has overall a shape of the conventional type, i.e. is substantially wide at the top end, narrower towards the bottom end and then wide again at this bottom end with a width less than that of the top end.

The tongue consists of a front part or portion, denoted in its entirety by 10, made of rigid material, such as plastic or the like, and a rear part or portion, denoted in its entirety by 12, which can be defined generally as tongue padding. In reality it will be seen that the part 12 is more precisely a composite or composable portion, it being possible for it to be structured in different ways for example with zones with a varying degree of padding and/or zones with reinforcing elements or finally with padding which can be varied and/or modified. All these aspects will obviously be clarified in the continuation of the present description.

Both the part 10 and the part 12 have a cross-sectional shape which on the whole is of the conventional type since both are concave on the side facing the user's leg against which in particular the rear part 12 must adhere.

The front part 10 is therefore convex at the front so as to engage with the opposing wall of the boot.

The material from which the front part 10 is made is known per se and generally is a plastic such as, for example, polyethylene of suitable rigidity. From the aforementioned figures in particular it can be seen also that, according to the invention, applied to the top end of the part 10 there is a central strip 14 consisting of temporary fixing means such as, for example, a Velcro type fastening (a textile mechanical hook and lock arrangement), the strip 14 of which may for example constitute the "furry" half of the said fastening.

The part 10 is provided finally in a known manner, at its bottom end, with a hole 16 for applying a screw or a rivet for fixing the tongue to the anatomical shoe not shown.

According to one of the main characteristic features of the tongue according to the present invention, the said tongue is not a single-piece body as in the case of tongues of the conventional type but, on the contrary, the front part 10 and rear part 12 are separate from one another and connected to each, for example by means of stitching, only along a part of their contour as indicated by the stitching line 18 shown in FIGS. 1 and 2 which ends at 20 and 22, before reaching the top end of the parts 10 and 12.

As a result of the above design, the parts 10 and 12 define in the tongue a substantially longitudinal recess 24 which is partially visible in the cut-away zone of FIG. 1 and the entry end of which is denoted by 26 in FIG. 1 and 2.

The aforementioned recess 24 is intended to receive in general filling material for modifying the thickness of the tongue. Furthermore, depending on the particular design of the tongue and the type of material used, it will be possible to modify simultaneously the degree and/or type of padding and/or the thickness of the tongue.

In this embodiment the filling material which is inserted into the recess 24 is in practise intended to modify the thickness of the tongue. From the aforementioned figures it can be seen, in fact, that a substantially flat bar-shaped insert 28 is introduced into the recess 24, the length of which is slightly greater than that of the recess 24 such that its top end projects from the same.

This end of the insert 28 has formed in it a transverse slit 30 designed to allow a strip 32 to pass through, which strip forms the second element of the Velcro fastening referred to above and consists, for example, of the "hooked" half of the said fastening. As can be seen in particular from FIGS. 2 and 3, the rear end **32*a* of the strip 32 is fixed in any known manner, for example by means of glueing, to the rear part 12 of the tongue. The strips 14 and 32 therefore enable the insert 28 to be secured inside the recess 24 as can be seen in particular in FIG. 1 which shows how the strip 32, after passing through the slit 30 of the insert 28, is able to be easily applied to the strip 14. FIG. 7 also shows a possible advantageous modification of the insert 28, whereby it has more than one slit 30 through which the strip 32 is able to pass, in particular three slits, 30, 30*a* and 30*b* located one above another for example. This makes it possible to vary the amount by which the insert 28 is introduced into the recess 24, by passing the strip 32** through one slit rather than another. By introducing the aforementioned insert to a greater or lesser extent, the tongue can be adapted to the particular contour of the foot's instep.

A further possible modification of the insert 28 can be seen in FIG. 8 which illustrates its bottom end having formed in it a weakening (or perforated) line **28*a* which allows the said user to shorten the insert 28 by removing a strip portion of insert 28, as shown in FIG. 8**. It is obvious that there may be more than one weakening (or perforated) line.

However, it is obvious that any other securing means, for example snap-engagement buttons or the like, could be used as an alternative to the Velcro fastening envisaged in the example of embodiment considered. The material from which the insert 28 is made may consist of a known moldable material, such as plastic or the like, such that its shape can be adapted perfectly to that of the user's leg.

With reference now, in addition to FIGS. 1 to 3, to FIG. 4 as well, it can be seen that the rear part 12 of the tongue has a rear coating or lining 34 and a front coating or lining 36 joined together at their perimeter for example by means of a stitching 37. A shaped insert 38 made of a plastic such as polyethylene or the like is fitted internally and is combined in any known manner with the linings 34, 36. Said insert 38, in the example considered, has two thicker portions 40 arranged in a substantially symmetrical position with respect to an essentially vertical median line and two portions 42, which are also thicker, essentially in the shape of a triangle with curvilinear sides, they too being arranged symmetrically with respect to the aforementioned vertical median line. As can be seen in particular from FIG. 1, the portion 42 define a seat 44 for the top end of the insert 28 in the secured position.

The shaped insert 38, like the insert 28, may also be made of moldable material such as plastic or the like.

From FIGS. 3 and 5 it can be seen that a shaped anatomical padding 46, having substantially the same shape as the corresponding part of the front portion 10, is fitted between the lining 34 and 36, beneath the insert 38. The padding 46 is made of a foam-like material known per se, the density of which may vary from case to case. The padding 46 is extended at the top and at rear of the shaped insert 38 by a layer of foam-like material 48 so as to soften the pressure exerted by the shaped insert 38 on the user's leg.

The shape of the shaped insert 38 as well as that of the anatomical padding 46 and the provision of the layer of foam-like material 48 are to be regarded as being only examples of embodiment of the rear part 12 of the tongue, and the possible variations thereof must be regarded as an indication of the numerous constructional designs of the tongue.

The second embodiment of the tongue according to the present invention will now be described, with particular reference to FIG. 6.

This variation of embodiment is particularly interesting since, as a result of its design, the tongue may be assembled, as and when required, by the user him/herself. The manufactured is therefore able to sell the tongues in the form of an assembly pack or kit.

In the aforementioned Figure the elements which are the same as those in preceding figures are indicated by the same reference numbers.

It can be seen that, in this embodiment, the front part 10 is still the same as that of the first embodiment, while the rear part 12 consists of a single lining 34 which, in this case also, together with the front part 10 defines the recess 24.

50 and 52 illustrate, schematically and by way of example, two inserts which may both consist of spongy material, or one of which may be spongy and the other one made of plastic, and which are designed to be introduced into the recess 24 as indicated by the arrows F of FIG. 6. The shape of the inserts 50 and 52, as shown in this figure, is purely indicative for the sake of simplicity of the drawing, this shape having to be adapted in each case such that the insert fills the recess 24 completely. Obviously the number and type of the inserts to be introduced into the aforementioned recess will vary from case to case, depending on the thickness and the degree of packing of the tongue. Advantageously the manufacturer will be able to sell the tongue in an assembly pack containing a greater number of inserts than strictly necessary such that the same assembly pack is able to satisfy the requirements of a greater number of users. Furthermore the user, as a result of the above expedient, will be able to vary the structure of the tongue as required. Securing of the inserts 50, 52, in this case also, is performed by joining the strips 32 and 14 and obviously the height of the inserts must be equal to or slightly less than the length of the recess 24. The advantages arising from the tongue according to the invention are obvious and may be summarised as follows: the versatility of use of the said tongue, the possibility of modifying or diversifying its structure and its adaptability to a wide range of customers.

Finally it is obvious that structurally and conceptually equivalent variations and/or modifications may be made to the tongue according to the present invention without departing from the protective scope of the invention itself.

It is obvious, for example, that, in the case of the first embodiment also, it is possible to envisage the possibility of introducing padding material into the aforementioned recess in place of the insert 28.

We claim:

1. A tongue for an anatomical liner of a rigid-shell ski boot comprising:

(A) an elongated, rigid front part;

(B) a padded rear part attached to the front part and engagable with a leg of the boot user;

(C) an elongated recess between the front part and the rear part;

(D) at least one elongated insert of a size and configuration as to be receivable in the recess;

(E) an opening at an upper portion of the recess having a configuration sufficient to allow passage of the insert thereinto, such that the insert may be manually and incrementally positioned from outside of the recess by a boot user at a plurality of pre-selected vertical locations in the recess relative to the leg of the user and thereby manually and incrementally adjust the thickness of the tongue; and (F) securing means operable by the boot user from outside of the recess for manually releasably securing the insert at any one of said pre-selected locations.

2. Tongue as claimed in claim 1, characterized in that said insert modifies the padding of the tongue.

3. Tongue as claimed in claim 1, characterized in that the padded rear part incorporates a further shaped insert made of plastic.

4. Tongue as claimed in claim 3, characterized in that the height of said shaped insert is less than that of the padded rear part.

5. Tongue as claimed in claim 4, characterized in that an anatomical padding of a foam-like material is placed in the remainder of the length of said rear part not occupied by said shaped insert.

6. Tongue as claimed in claim 1, characterized in that the insert is in the form of at least one shaped element made of plastic.

7. Tongue as claimed in claim 1, characterized in that the insert has a height greater than the depth of the recess and, at its upper end, has at least one transverse slit for passing through a first fastening strip fixed at one end to the rear part and adapted to engage at an other end a second fastening strip fixed externally on the front part, said first and second strips forming the securing means.

8. Tongue as claimed in claim 1, characterized in that the insert has, at its lower end, at least one weakening line for allowing removal of a perimetral strip of the insert in order to reduce the height of the insert.

9. Tongue as claimed in claim 1, characterized in that the front part and the rear part are joined together along most of at least peripheral edges of each except at an upper zone of said edges which define said opening.

10. Tongue as claimed in claim 1, characterized in that the rear part essentially consists of a lining defining, together with the front part, the recess and the insert is made of spongy and/or plastic material.

* * * * *